US006176487B1

(12) United States Patent
Eklund et al.

(10) Patent No.: US 6,176,487 B1
(45) Date of Patent: Jan. 23, 2001

(54) SYSTEM AND A METHOD FOR GENERATING GAME PIECES AND MOVEMENT SEQUENCES

(75) Inventors: Gert Eklund, Hovås; Lars Nordberg, Göteborg, both of (SE)

(73) Assignee: GE- Spelutveckling AB, Gothenburg (SE)

( * ) Notice: Under 35 U.S.C. 154(b), the term of this patent shall be extended for 0 days.

(21) Appl. No.: 09/091,195

(22) PCT Filed: Mar. 4, 1997

(86) PCT No.: PCT/SE97/00358

§ 371 Date: Nov. 4, 1998

§ 102(e) Date: Nov. 4, 1998

(87) PCT Pub. No.: WO97/32639

PCT Pub. Date: Sep. 12, 1997

(30) Foreign Application Priority Data

Mar. 4, 1996 (SE) ..... 9600850

(51) Int. Cl.[7] ..... A63F 3/00

(52) U.S. Cl. ..... 273/249; 273/138.1; 273/139; 273/138.2; 463/16; 463/17; 283/903

(58) Field of Search ..... 273/138.2, 138.1, 273/139, 249; 463/17, 16; 283/903

(56) References Cited

U.S. PATENT DOCUMENTS 3,826,499 * 7/1974 Lenkoff ..... 273/139
5,092,598 * 3/1992 Kamille ..... 273/139
5,411,260 * 5/1995 Smith ..... 273/139
5,601,287 * 2/1997 Lundin ..... 273/138.2
5,931,467 * 8/1999 Kamille ..... 273/139

FOREIGN PATENT DOCUMENTS

WO 94/03873 2/1994 (WO) .

* cited by examiner

*Primary Examiner*—Benjamin H. Layno
(74) *Attorney, Agent, or Firm*—Oppedahl & Larson LLP

(57) ABSTRACT

The invention is directed to a system and a method for generating game pieces and movement sequences. The game pieces are used in a game of chance having a predetermined number of winners with respect to the movement sequences. By way of moves determined by randomly selected movement sequences, a player's marker is directed from a start position to an end position on a game piece. The method involves selecting the vertical difference (number of grid sections) between the start and end positions on the game piece, dividing the game pieces into parts and preferably randomly generating a series of marker moves for each part of the game piece. The series of marker moves, when applied to a game piece, results in a player's marker traveling from the start position to the end position. The system includes a computer arranged to generate and store the series of marker moves which, when applied to a game piece, causes the player's marker to travel from the start position to the end position. At the end position, and optionally at various positions throughout the game piece, a prize indicator may be located.

19 Claims, 2 Drawing Sheets

SYSTEM AND A METHOD FOR GENERATING GAME PIECES AND MOVEMENT SEQUENCES

BACKGROUND OF THE INVENTION

The present invention relates to a system and a method for generating game pieces and movement sequences for a game of chance. The game pieces are used in an interactive game of chance with a predetermined prize distribution. When the game is played, one of the generated movement sequences is randomly selected. The movement sequence comprises a series of directions, directing moves of a player's marker on the game piece; the moves taking place from a start position to an end position.

It is essential to be able to guarantee that the prizes in a game of chance, such as a lottery, at least distributed over several plays, yield a certain predetermined number of winners. This means that the number of winning game pieces, and the prizes won are predetermined to occur within a certain range. The prizes on the game pieces could for instance correspond to a certain sum of money or could give the winner a chance to take part in other forms of games having other prizes, such as larger sums of money. However, the process of generating game pieces and movement sequences becomes complicated when the number of game pieces, movement sequences and possible moves from the start to the end positions and possible prize indicator positions on the game pieces is considerable. This is because of the very large number of possible combinations of these parameters.

SUMMARY OF THE INVENTION

A method is provided for generating a game of chance involving game pieces and movement sequences. The game pieces and movement sequences are generated in such a way that a predetermined number of winners is achieved. The game pieces comprise a grid of columns and rows forming grid sections through which a player's marker moves, from a start position to an end position on the game piece. The movement sequences comprise a series of movement instructions to direct movement of the player's marker from the start position to the end position. With respect to just the start and end positions, a vertical difference, in number of grid sections, between the start position and the end position on the game piece is selected, and movement sequences are generated which, when applied to game pieces, result in the player's marker moving from the start position to the end position. Having the end position the selected number of grid sections vertically above or below the start position is a key factor in achieving the predetermined number of winners.

DETAILED DESCRIPTION OF THE INVENTION

The first object of the present invention is to provide a method and a system for generating game pieces and movement sequences having a predetermined number of winners.

The second object of the present invention is to provide a method and a system for generating game pieces and movement sequences. The number of possible combinations of various parameters that affect the generating process, such as the number of movement sequences, different configurations of the game pieces and the positions of the prize indicators on the game pieces becomes manageable, allowing rapid and easy generation of game pieces and movement sequences.

The method and system for generating game pieces and movement sequences are also aimed at meeting the conventional requirements established for lotteries.

Figure 1:
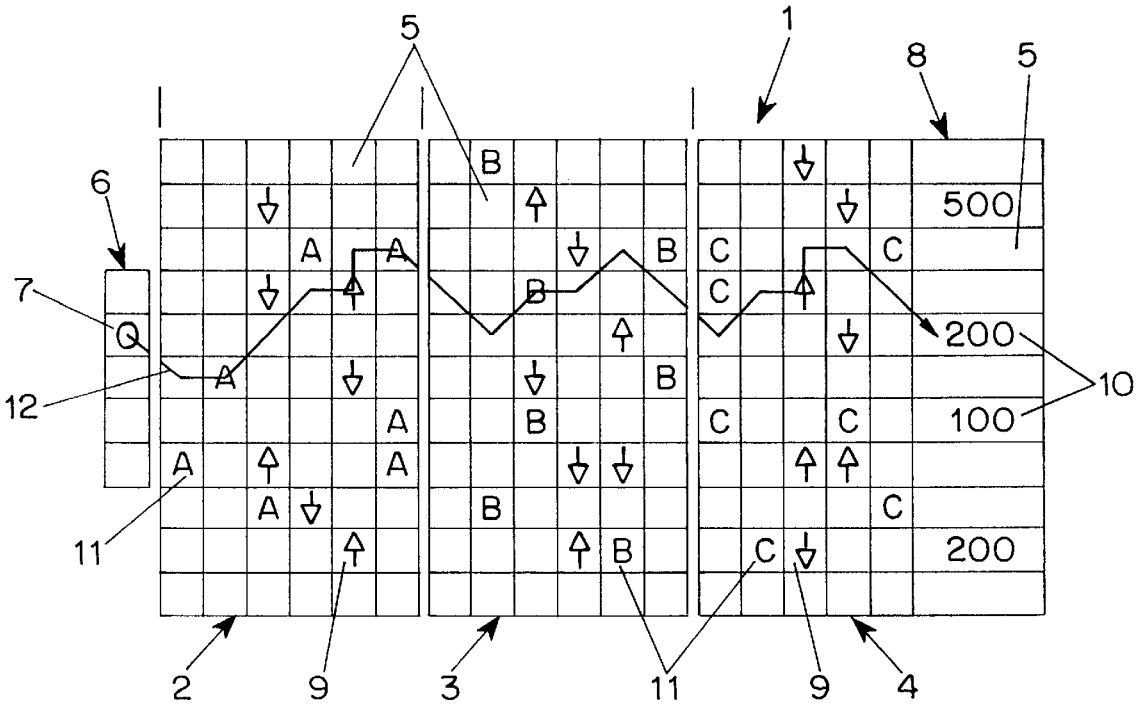
FIG. 1 illustrates one example of a game piece, showing marker moves with respect to one movement sequence from a start position to an end position.

The game piece of FIG. 1, generally referred to by reference 1, is divided into three parts, generally indicated by references 2, 3 and 4, respectively. In accordance with the embodiment shown, each part of the game piece comprises a grid comprising six columns and eleven rows, and the parts 2, 3 and 4 are positioned side by side. The columns and the rows delimit sections 5, of square configuration in accordance with the embodiment shown. The game piece 1 has a start column generally designated by reference 6. In accordance with the embodiment shown, the start column 6 comprises five sections and is vertically centered about the middle rows of the parts 2, 3 and 4. In one of the sections of the start column 6 is a mark 7 indicating a start position. The game piece 1 also comprises an end column generally designated by reference 8. The end column is a column in part 4 in accordance with the embodiment shown.

The game piece also comprises directors 9. In one embodiment the directors are in the form of arrows pointing vertically upwards or downwards. The directors 9 are disposed in three columns in parts 2 and 3 in accordance with the embodiment shown, and in two columns in part 4. In other embodiments, the directors 9 are present in more or fewer columns, and in different rows on the game piece.

The end column 8 shows a number of prize indicators 10 which in the example illustrated are different sums of money. In some sections of parts 2, 3 and 4 there are also prize indicator signs 11, represented by the letters A, B and C. In accordance with the embodiment shown, all A's are found in the first part, all B's in the second part and all C's in the third part. This is not necessary. Each type of prize indicator sign may appear in one or more parts of the game piece. For example, A's could appear in all parts of the game piece. The number of different types of prize indicator signs 11 could exceed or be lower than that shown.

During the generation process, game pieces of the kind shown in FIG. 1 and movement sequences are created. The movement sequences consist of a series of marker moves which would move a marker from a start position to an end position on the game piece. Once the generation process is completed, the game pieces are sold to players before the movement sequence is presented. During the presentation, one of the generated movement sequences is selected at random and presented to the players. The movement sequence and the directors 9 work in combination to define the movement of a marker across a given game piece. In accordance with the example shown in the figures, the marker moves proceed laterally from the left to the right across sections on the game piece. The lateral moves in the movement sequences may be horizontal, diagonally upwards, or diagonally downwards. FIG. 1, line 12 indicates one example of marker moves generated by one movement sequence/director combination. When the marker hits a director 9 it should be moved upwards or downwards in the direction indicated, to an adjacent section. Thus, although the same set of moves is designated by the movement sequence, the result (the prize won) will depend on the locations of the directors 9 and the start position. In one embodiment, the start column 6 has an opaque scrape-off cover hiding the start position 7. This feature in combination with the directors 9 and the fact that the movement sequence is preferably disclosed move by move, for example during a television transmission, make the marker moves an exciting part of the game to the player. In the example shown, the player is lucky since the marker hits two prize indicator signs A, which in this example generates a prize, and since the marker hits price indicator 200, a prize of 200 SEK is awarded.

It is easily understood that the number of possible combinations of parameters, including different movement sequences, different positions of the directors 9, different start positions and different positions of the prize indicators 10 and 11 is large. The number of possible combinations must be limited in the generation of game pieces and movement sequences in order to achieve a predetermined number of winners.

In one embodiment, illustrated in the figures, 10,000 game pieces are to be generated and the movement sequence is selected from 1,000 generated movement sequences.

In order to obtain a predetermined number of winners with respect to the prize indicators 10 in the end column and to make the generation process manageable, the first step is selecting the vertical difference (number of sections S) between the start and end positions on the game piece. As shown in the figures, S=0 because the start and end positions are in the same row. In accordance with a preferred embodiment, S is the same for all game pieces. This facilitates generating game pieces such that a predetermined number of winners is achieved. Because S is known, it is easy to select, preferably at random, a number of game pieces presenting a prize in the end column. These counters are generated with a start position, the vertical location of which generates a predetermined end position, based on the selected S, independently of the selected movement sequence. In FIG. 1, with a selected S =0, if the game piece were to be a winner of the 200 prize, the start position must be the second section from the top in the start column. A prize indicator is then placed in the end position. All game pieces that should not result in a prize in the end column have no prize indicator in the end position. Alternatively, the system may be based on a predetermined prize-winning outcome, for example in the form of pre-printed prizes in certain sections of the end column. The start position is then adapted to this situation, based on the selected S, such that certain prize-winning game pieces are generated, preferably at random.

Once S is established, the game pieces are divided into parts (2, 3, 4) in order to further facilitate the generation process. For each part, the desired number of small steps vertically $S_1$, between the sections in the first and the last columns in the direction of marker moves is determined, preferably at random. The sum of the number of small steps for all of the parts should be S, i.e. $S_1+S_2+. . . S_1=S$. Negative numbers indicate steps up and positive numbers indicate steps down. In accordance with the example shown in FIG. 1, the number of small steps $S_1=-2$ in the first part. From the start position to the end position in the first part, the marker moves two steps up. In the second part the number of small step $S_2=+1$ and in the third part the number of small step $S_3=+1$. For the second and third parts, the number of small steps is calculated from the end position in the previous part to the end position in the current part. Thus, in the FIG. 1, $S=S_1+S_2+S_3=-2+1+1=0$. In accordance with a preferred embodiment, $S_1$ is common to the first part of all game pieces (−2), $S_2$ is common to the second part of all game pieces (+1) and $S_3$ is common to the third part of all game pieces (+1). This results in all game pieces having the same number of small steps in corresponding parts, which facilitates the generation of game pieces such that a predetermined number of winners is achieved. In accordance with the preferred embodiment, the numbers of small steps $S_1$ are chosen within the range −2 to +2 and S is chosen within the range −6 to +6. The chosen numbers of small steps are stored in a first register on a computer.

Each part of the game piece in accordance with the example shown in the figures comprises 729 ($3^6$) possible different series of marker moves which may comprise moves from the left to the right on the game piece in the directions diagonally upwards, diagonally downwards, or horizontally. The various series of marker moves for each part of the game piece together form different movement sequences with respect to that game piece. In accordance with a preferred embodiment certain non-desired series of marker moves and/or movement sequences are sorted out. For example, movement sequences and/or series of marker moves comprising more than three identical marker moves in sequence may be sorted out, since such movement sequences and/or series of marker moves may be felt as less exciting by the player. For the same reasons, in accordance with the preferred embodiment, movement sequences which, in total, comprise more than seven identical marker moves are sorted out.

Figure 2:
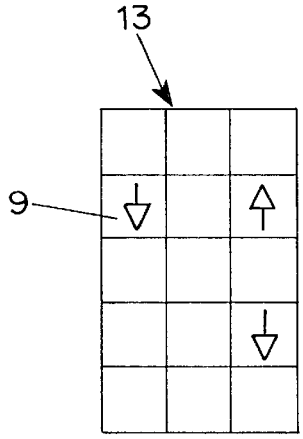
FIG. 2 illustrates one example of a director area of a game piece.

Each part 2, 3, 4 of the game piece, in accordance with the shown embodiment, comprises a director area, generally indicated in FIG. 2 by reference 13. In the embodiment illustrated, the director area 13 has a width of three columns and a height of five rows, but the size may be varied. Preferably, the director area has a size and location such that it covers sections in only part of the game piece in order to facilitate the generation process. For the director area 13 of each part of the game piece, a list of director patterns 14 is generated. The director patterns 14 show different possible ways of positioning the directors 9 in the director area 13. One list for each part of the game piece is stored in a second register on a computer. FIG. 2 illustrates one example of director positions in a director pattern 14 relating to director area 13. The number of directors in each director pattern 14 preferably is restricted to ensure that the directors 9 will not be too close to one another. In a preferred embodiment, the number of directors in each director pattern is limited to one, two or three.

Figure 4:
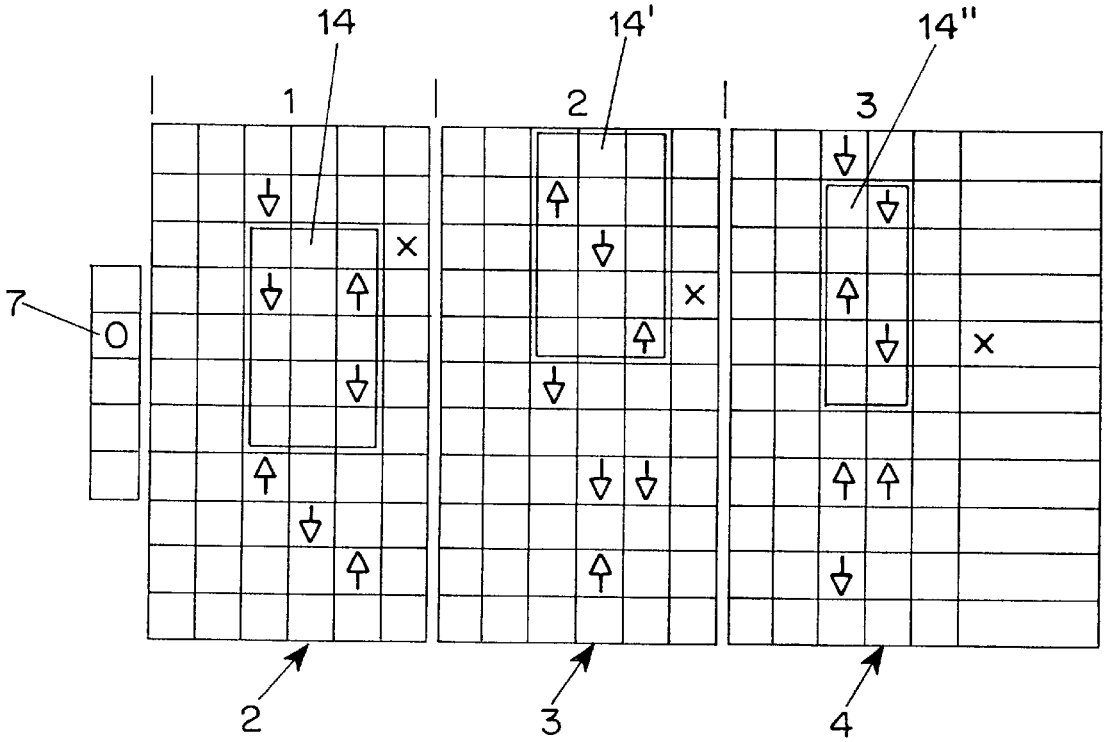
FIG. 4 illustrates one example of the disposition of director areas on the game piece of FIG. 1.

FIG. 4 illustrates one example of a game piece in which three director patterns 14, 14', 14" are set out. Each of these patterns has three directors. Director pattern 14" comprises only two columns. A very large number of different combination possibilities exists between different patterns. In order to make the generation process manageable, the number of pattern combinations should be restricted.

The lists of director patterns 14, 14' and 14" for the first, second and third parts, respectively, are sorted in such a manner that the patterns producing numbers of small steps $S_1$, $S_2$ and $S_3$ comprising the largest number of marker move series appear first. The result for each part is stored in a third register on a computer.

A number of patterns are then randomly selected from each one of the three sorted lists, and the selected patterns are stored in a fourth register on a computer. It should be noted that the lists in the third register are sorted in such a manner that the patterns that may be combined with the largest number of series of marker moves appear first. These are the best series of marker moves. The selection is preferably performed using a random-number distribution which is not linear in the population but configured in such a manner that the first, best series of marker moves has the best chance of being selected.

Thereafter a list of the series of marker moves which, when applied to the patterns in the fourth register relating to the first part of the game piece, continues to produce the above-mentioned number of small steps $S_1$. The generated list is stored in a fifth register relating to the first part of the game piece. In the same manner, lists of the series of marker moves relating to the second and third parts of the game piece are generated, which when applied to the associated pattern in the fourth register produces the above-mentioned numbers of small steps $S_2$ and $S_3$, respectively. Since the number of series of marker moves is thus restricted, it is advantageous to be able to combine patterns with many associated series of marker moves to obtain a list containing a sufficient number of selection lists to produce the correct number of small steps in all patterns of the part of the game piece. This is the reason behind the nonlinear random-number distribution mentioned above.

In this manner a list of patterns and series of marker moves is produced for each part of the game pieces which together produce marker moves corresponding to the small steps of the part of the game piece.

Three patterns from the fourth register, one for each part of the game piece, are now combined and positioned on a game piece. In accordance with the example in FIG. 4, the pattern of the first part is centered about a preferably randomly selected row comprising start position 7. In the first part, the number of small steps $S_1$ is −2. Since all of the series of marker moves in the first part all start in the same start position 7 and are all restricted to produce marker moves extending through the pattern 14 and since all of the series of marker moves of the first part have the same number of small steps $S_1$, all these series of marker moves have a common end point for the first part of this game piece, which is indicated by an X in the right-hand column in FIG. 4. The patterns 14' and 14" of the second and third parts are placed in a similar manner. For determining the number of small steps, the X in the previous part is used as the starting position. Corresponding restrictions apply in the second and third parts of the game piece and the end position in the third part is predetermined in relation to the starting position (S=0).

The appearance of the game piece changes when different patterns are combined and when different start positions are selected. If the total number of game pieces having different pattern positions is less than the desired number, which in this case is 10,000, some of the combinations are re-used to give the desired number of game pieces. Game pieces having identical patterns and start positions yet are likely to be given different appearances, owing to the distribution of prize indicators 10, sign prize indicators 11 and directors 9 which are positioned externally of the director patterns 14.

The three lists, one for each part of the game piece, comprising series of marker moves having a length of six steps in the respective fifth registers are then combined in order to produce a set of movement sequences having a length of 18 steps which are stored in a sixth register. 18 steps are needed to move a marker from the start position to the end position because each of the three parts has 6 columns. When a player's marker hits a director, the marker moves in the direction indicated by the director, and this additional move is not considered an additional step. Owing to the generating method all these movement sequences produce the same S for each game piece produced. In accordance with a preferred embodiment, an extra run-through of the movement sequences is made, maximizing the number of allowable steps of the same kind to seven and ensuring that no more than three identical marker moves in succession exist. If the number of generated movement sequences is less than the desired number, in this case 1,000, the generating process must be re-started from the beginning.

In accordance with a preferred embodiment, it is ensured that the marker will not be positioned outside the game piece. This may be achieved by applying all of the generated movement sequences to each game piece and sorting out movement sequences producing the above problems.

As described above, the movement sequences produce a predetermined number of winners with respect to the prize indicators in the end column. In a preferred embodiment, prize indicators are also placed in sections that are not hit by the marker in both prize-winning and blank game pieces in order to increase the player's excitement. Examples of such an arrangement is shown in FIG. 1 in which the sum SEK 500 is not scored.

The embodiment in FIG. 1 also comprises prize indicator signs 11. When a prize indicator sign is hit by the marker, the player wins the corresponding prize. In another embodiment, more than one indicator must be hit by the marker in order to win the prize. Preferably these prizes also have a predetermined number of winners. This, however, raises a problem since at the time the game piece is printed, the movement sequence to be selected is still unknown. This problem is solved by the present invention by applying all movement sequences in the sixth register to each game piece. For each movement sequence, data relating to which sections are hit by the marker on each game piece is then stored in a seventh register. The system counts the number of marker hits in each section. This data is also stored in the seventh register.

Figure 3:
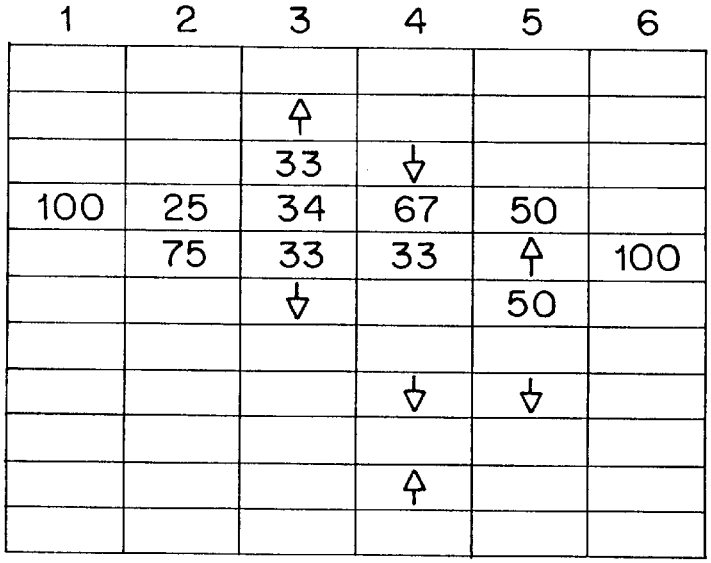
FIG. 3 illustrates on an enlarged scale a part of the game piece of FIG. 1, showing digits indicating the distribution by percentage of the number of marker hits in the movement series with respect to different sections of the game piece.

In this manner the system tracks which sections are hit on each game piece and the number of hits in each section of all game pieces. FIG. 3 illustrates schematically a distribution of hits by percentage of all movement sequences with respect to a part, such as the first part, of all game pieces.

In the most simple case it suffices that the marker hits a prize indicator in order for the player to win a prize. Initially, a column in which the prize-producing indicator is to be positioned is selected, preferably at random. For example, column 4 in FIG. 3 is selected. In this column there are two sections with multiple hits. For the sake of simplicity we assume that only one marker-related prize is to be set out. A first game piece is selected, preferably at random, for example one having at least one or several marker hits in the upper one of the two hit sections of column 4, and a second game piece is selected preferably at random, which has at least one or several marker hits in the lower one of the two hit sections of column 4. A prize indicator is placed on the first game piece in the upper one of the two hit sections of column 4 and a prize sign indicator is placed on the second game piece in the lower one of the two hit sections of column 4. Thus a prize is ensured in column 4, independently of the movement sequence that is selected in the lottery.

In another embodiment, a prize is obtained only if two prize indicator signs are hit by the marker. In the same manner as above, two columns in which prize-producing signs are to be found are selected. For example, columns 2 and 5 in FIG. 3 are chosen. In each one of these columns two sections are hit. This gives rise to four possible movement sequence combinations. Four game pieces are randomly selected, and prize indicator signs are positioned on these game pieces in the hit sections such that a first game piece has prize indicator signs in the two upper hit sections of columns 2 and 5, a second game piece has prize indicator signs in both the two lower hit sections in columns 2 and 5, a third game piece has prize indicator signs in the upper hit section of column 2 and the lower hit section in column 5, and a fourth game piece has signs in the lower hit section of column 2 and the upper hit section in column 5.

In another embodiment, "blind" prize signs not yielding prizes are placed in some sections that are not hit in any movement sequence, or in such a manner that not all signs required for a prize are hit, in order to enhance the player's excitement. In one embodiment, two or more of a single type of prize indicator sign must be hit in order to win the prize. As shown in the example in FIG. 1, the player wins prize "A" because two of the A's were hit. According to a preferred embodiment, the sections that contain directors 9 in the patterns of each game piece are listed and stored. "Blind" directors in some sections which are not hit in any movement sequence may also be listed and stored. Such directors are shown in FIG. 4 lying outside of the director patterns. These "blind" directors are arranged in sections of the patterns not hit in any movement sequence. When positioning these "blind" indicators it is preferable to list and store data relating to which sections have become "occupied", in order to ensure that directors and prize indicator signs are not positioned on top of one another. Preferably, the "blind" signs and the directors are arranged at random on the non-occupied sections.

Preferably, the above-mentioned generating process is carried out at least partly in a system comprising a computer.

The system and method of the instant invention ensure a predetermined number of winners. Owing to the division of the game piece into parts comprising definite numbers of small steps and owing to the division of the parts in accordance with a preferred embodiment into director areas in which directors may be positioned and by means of which the marker is moved by the series of marker moves, the number of possible combinations in the generation process becomes manageable. This results in the rapid generation, in a system comprising a computer, of game pieces and movement sequences, while at the same time retaining the requirement for a random quality in the selection of winning game pieces.

It shall be understood that certain changes of the inventive method and system are possible. For instance, the appearance of the game piece, the size of its parts and the patterns etc., illustrated in the figures are to be regarded as non-restricting embodiments. It is also possible to have a larger or smaller number of parts to the game piece. It is not necessary to generate directors on the game piece. The description of the method and system of this invention is not intended to be limiting to this invention, but is merely illustrative of the preferred embodiment.

We claim:

1. A method of generating a game of chance involving game pieces and movement sequences, the game pieces and movement sequences being generated such that a predetermined number of winners is achieved, wherein the game pieces comprise a grid of columns and rows forming grid sections, wherein a player's marker moves through the grid sections in a path through a plurality of adjacent grid sections, said path extending from a start position to an end position on each game piece, wherein the movement sequences comprise a series of movement instructions to direct movement of a marker from the start position to the end position, the method comprising the steps of:

with respect to just the start and end positions, selecting a vertical difference, in number of grid sections, between the start position and the end position on the game piece, and generating movement sequences which, when applied to game pieces, result in a marker moving from the start position to the end position wherein the end position is the selected number of grid sections vertically above or below the start position, wherein the predetermined number of winners is achieved.

2. The method of claim 1, wherein the vertical difference, in number of grid sections, between the start position and end position on the game piece is the same for all game pieces.

3. The method of claim 1, wherein the start position is different for some of the game pieces.

4. The method of claim 1, further comprising the step of selecting a number of game pieces containing a start position and placing a prize indicator in the end position, wherein the end position is determined by the start position according to the selected vertical difference between the start position and end position on the game piece.

5. The method of claim 1, further comprising the step of selecting a number of game pieces containing a prize indicator in an end position and placing a mark in the start position, wherein the start position is determined by the end position according to the selected vertical difference between the start position and end position on the game piece.

6. The method of claim 1, further comprising the steps of dividing the game piece vertically into parts and establishing a director area disposed within each part of the game piece; wherein a first part of the game piece comprises the start position, a second part of the game piece comprises the end position, and zero, one or more parts are between the first and second parts; wherein the director area contains one or more directors forming a director pattern, the directors indicating a direction of movement for a player's marker such that the director patterns comprise combinations of marker moves, wherein the combination of the movement sequence and the directors on the game piece results in movement instructions directing a player's marker from the start position through said director areas to the end position, resulting in the selected vertical difference in number of grid sections between the start and end positions on the game piece, wherein the predetermined number of winners is achieved.

7. The method of claim 6 wherein each game piece is a board comprising at least first and last parts, wherein each part of the game piece has a predetermined number of columns including first and last columns, wherein a first column in the first part of the game piece comprises the start position and a last column in the last part comprises the end position, and wherein the marker moves in the movement sequences comprise moves between adjacent columns from the first column in the first part towards the last column in the last part, the method further comprising the steps of:

selecting a difference in the number of grid sections vertically up or down between the location of a marker in the first column and the location of the marker in the last column in each part of the game piece, wherein the differences in the number of grid sections vertically up or down for all of the parts add up to the selected vertical difference between the start position and the end position, and generating a first series of marker moves for each part of the game piece, wherein the combined series of marker moves for the parts results in the marker moving from the start position to an end position which is the selected vertical difference in grid sections from the start position.

8. The method of claim 7, wherein the method further comprises the steps of:

determining and storing in a first register, the vertical difference in number of grid sections between the first and last columns for each part of the game piece, wherein said differences for all parts add up to the selected total vertical difference in the number of grid sections between the start position and the end position on the game piece;

generating a list of possible director patterns within the director areas for each game piece part, and storing the patterns in a second register;

sorting, for each part, the lists of director patterns such that the patterns producing the vertical difference in the number of grid sections between the first and last columns for each part and which comprise the largest number of marker move series and which may be combined with the largest number of series of marker moves appear first, and storing the sorted set of patterns for each part in a third register;

randomly selecting a number of patterns from the stored lists in the third register for each part, wherein the selection is performed using a random-number distribution which is not linear in the population but configured such that the first, best series of marker moves has the best chance of being selected, and storing the selected patterns in a fourth register for each part;

generating a list of the series of marker moves for each part, which, when applied to the patterns in the fourth register for the parts of the game piece, produces the vertical difference in number of grid sections between the first and last columns for each part, and storing the generated lists in a fifth register;

generating game pieces by combining patterns from the fourth register, one for each part of the game piece, and positioning the patterns on a game piece, the pattern in a first part adjacent the start column being centered vertically about a randomly selected first row of grid sections, the pattern of second and additional parts being positioned such that a marker, moving from the indicated position in the last column of the first part through the patterns in the second and additional parts, arrives at the determined end position in the last column of the last part; and combining the generated lists of marker moves for each part from the fifth register and storing the combinations in a sixth register, each combination in the sixth register forming one movement sequence.

9. The method of claim 8, further comprising the step of centering the director pattern in the first part vertically about a first row of sections that comprises the start position.

10. The method of claim 8, further comprising the step of selecting a common number of grid sections as the difference between the first and last column for a first part of all game pieces, selecting a common number of grid sections as the difference between the first and last column for a second part of all game pieces and so on for all parts, whereby all game pieces will exhibit the same number of grid sections as the difference between the first and last column in corresponding parts.

11. The method of claim 8, wherein prize indicator signs are present in some grid sections and wherein a prize is obtained if the marker hits one or several of these signs during its movement between the start and end positions, wherein the method comprises the steps of:

applying all movement sequences in the sixth register to each game piece, for each movement sequence, storing in a seventh register data relating to which grid sections are hit by a marker on each game piece and the number of marker hits in each section of all game pieces, selecting at random, on the game pieces, one or several columns in which said prize indicator signs are to be placed, selecting game pieces at random and, based on data in the seventh register, positioning on the selected game pieces in said columns one or several prize indicator signs in sections hit by the marker during at least some of the movement sequences, whereby the game pieces are selected and the prize indicator signs on the selected game pieces are positioned such that at least one prize indicator sign is always hit, independent of the movement sequence that is selected during performance of the game of chance.

12. A system for generating game pieces and movement sequences, said game pieces and movement sequences being used in a game of chance with a predetermined number of winners, wherein the game pieces comprise a grid of columns and rows and a player's marker is directed from a start position to an end position on each game piece by way of moves determined by a movement sequence randomly selected from said movement sequences, and wherein a vertical difference, in number of grid sections, between the start position and the end position on the game piece is selected prior to generating game pieces or movement sequences, wherein the start and end positions are the same for all game pieces, wherein the game pieces are divided into parts, wherein the system comprises a computer arranged to generate and store game pieces and series of marker moves for each part which together form movement sequences such that when applied to a game piece, generate said end position in relation to the start position.

13. The system of claim 12, wherein each part of the game piece has a selected director area, and the computer is arranged to generate said series of marker moves such that the marker moves on each game piece extend through said areas when the series of marker moves is applied to the game piece.

14. The system of claim 13, wherein each area has a number of marker move directors, and the computer is arranged to generate said series of marker moves in response to the marker moves caused by said directors in order to establish said vertical difference, in number of grid sections, between the start and end positions.

15. The system of claim 12 wherein each game piece comprises essentially parallel columns which are divided into sections which form a playing board in the form of a grid, wherein a start column in one part comprises the start position and an end column in another part comprises the end position, wherein the marker moves in the movement sequences comprise moves between juxtaposed columns from the start column towards the end column, wherein the end position relative to the start position is determined by the total vertical difference in the number of grid sections between these positions on the game piece, and wherein said game piece is divided into said parts in such a manner that each part comprises a predetermined number of columns, wherein the computer is arranged to generate at random and store, in registers, the series of marker moves for each part that result in a vertical difference in the number of grid sections between the first and last columns of the part taken in the direction of marker moves, said differences in all parts adding up to the total vertical difference, in number of grid sections, between the start position and the end position.

16. The system of claim 15 wherein the computer is further arranged to select a common vertical difference in the number of sections between the first and last columns for each part of all game pieces, to ensure that all game pieces exhibit the same difference in the number of sections vertically between the first and last columns in corresponding parts.

17. The system of claim 15, wherein prize indicator signs are present in some sections and a prize is obtained if the marker hits one or several of said prize indicator signs during its move between the start and end positions, wherein the computers is arranged to apply all movement sequences to each game piece;

store in a seventh register for each game piece the sections hit by a marker during each movement sequence;

randomly select one or several columns on the game pieces in which said prize indicator signs are to be positioned;

randomly select game pieces and on the basis of date in the seventh register on the selected game pieces in said columns positioned one or several signs in sections hit by the marker during at least some of the movement sequences; and select game pieces and position prize indicator signs on the selected game pieces, ensuring that at least one prize indicator sign is always hit, independently of which movement sequence is selected in the game of chance.

18. The system of claim 12 wherein each game piece has essentially parallel columns which are divided into sections which form a playing board in the form of a grid, wherein a start column in one section comprises the start position and an end column in one section comprises the end position, wherein the marker moves in the movement sequences comprise moves between juxtaposed columns from the start column towards the end column, wherein marker moves also are performed vertically within each column by means of marker move directors arranged on the game piece, wherein the location of the end position relative to the start position is determined by the total vertical difference in the number of sections between said positions and wherein said game piece is divided into said parts such that each part comprises a predetermined number of columns, wherein the computer is arranged to randomly determine and store, in a first register, the vertical difference in the number of sections between the first and last columns of each part, moving in the direction of marker moves such that the total vertical difference in the number of sections between the first and last column for all parts produces the selected total vertical difference in the number of sections between the start position and the end position, each part of the game piece comprising a director area comprising at least a number of the sections of that part;

generate possible directors within the areas and store the various directors in the form of patterns in a second register;

sort and store in a third register, the patterns in the second register for each part depending on the number of combinations of marker moves between juxtaposed columns in the part that results in the vertical difference in the number of sections between the first and last columns;

select at random from the third register established for each part, and store in a fourth register, a number of patterns, said selection being produced with a non-linear distribution such that patterns which are combinable with the highest number of series of marker moves resulting in said vertical difference in the number of sections between the first and last columns for the part possess the best chance of being selected;

generate for the fourth register of each part and store in a fifth register, a series of marker moves resulting in the vertical difference in the number of sections between the first and last columns of the part for all patterns in the third register;

generate game pieces by combining patterns from the fourth register for the various parts of the game piece and set up a pattern combination on each game piece such that each part is assigned a pattern from the fourth register of the part, whereby the pattern in a first part adjacent a start column is centered vertically about a randomly selected first row of sections, whereby the pattern of a second part following the first part as seen in the direction of a marker moves is centered vertically about a second row of sections which is arranged at a distance vertically that corresponds to the vertical difference in the number of sections between the first and last columns of the first part relatively to the first row, and whereby the patterns of the remaining parts are correspondingly centered vertically relatively to a pattern located in an adjacent, previous part taken in the direction of movement of the marker, depending on the vertical difference in the number of sections between the first and last columns of the part of that pattern; and combine the series of marker moves in the fifth register for each part and store the combinations in a sixth register, each combination in said sixth register forming one of the movement sequences.

19. The system of claim 18, wherein the computer is further arranged to center the pattern in the first part, adjacent the start column, vertically about a first row of sections that comprises the start position.

* * * * *